US005364000A

United States Patent [19]

Fealey

[11] Patent Number: 5,364,000

[45] Date of Patent: Nov. 15, 1994

[54] STAPLING PLIER

[75] Inventor: William S. Fealey, Jamestown, R.I.

[73] Assignee: Stanley-Bostitch, Inc., East Greenwich, R.I.

[21] Appl. No.: 48,427

[22] Filed: Apr. 14, 1993

[51] Int. Cl.[5] ..... B25C 5/11

[52] U.S. Cl. ..... 227/124; 227/120; 227/134

[58] Field of Search ..... 227/124, 120, 125, 156, 227/127, 134

[56] References Cited

U.S. PATENT DOCUMENTS

| | | | |
|---|---|---|---|
| 348,236 | 8/1886 | Richards . | |
| 1,654,170 | 12/1927 | Hubbard . | |
| 2,326,540 | 8/1943 | Krantz . | |
| 2,354,760 | 8/1944 | Lindstrom . | |
| 2,420,830 | 5/1947 | Maynard . | |
| 2,438,712 | 3/1948 | Lindstrom . | |
| 2,461,165 | 2/1949 | Lindstrom | 227/124 X |
| 2,493,640 | 1/1950 | Peterson . | |
| 2,682,053 | 6/1954 | Ruskin et al. | 227/124 X |
| 2,755,474 | 7/1956 | Spencer | 227/124 |
| 2,769,174 | 11/1956 | Libert . | |
| 2,795,787 | 6/1957 | Spencer | 227/124 |
| 2,996,720 | 8/1961 | Mackechnie | 227/120 X |
| 3,172,122 | 3/1965 | Clay . | |
| 3,229,882 | 1/1966 | Abrams . | |
| 3,368,731 | 2/1968 | LaPointe | 227/124 |
| 4,126,260 | 11/1978 | Mickelsson . | |
| 4,184,620 | 1/1980 | Ewig . | |
| 4,225,075 | 9/1980 | Chi . | |
| 4,450,998 | 5/1984 | Ruskin . | |
| 4,452,388 | 6/1984 | Fealey . | |
| 4,483,066 | 11/1984 | Akira | 227/120 X |
| 4,687,098 | 8/1987 | Ebihara . | |
| 4,984,729 | 1/1991 | Balma | 227/120 X |
| 5,131,580 | 7/1992 | Allman . | |

*Primary Examiner*—Rinaldi I. Rada

*Attorney, Agent, or Firm*—Samuels, Gauthier & Stevens

[57] ABSTRACT

A stapling plier has a magazine adapted to contain a supply of detachably interconnected staples, and resiliently biased driver and clincher arms pivotally connected to the magazine for movement between open and closed positions. The magazine has an exit throat and the driver and clincher arms are provided respectively with driver and clincher elements. An operating lever is pivotally connected to the clincher arm and has arcuate surfaces in sliding contact with complimentary arcuate surfaces on bearings journalled for rotation on the driver arm. Pivotal closure of the operating lever causes closure of the driver and clincher arms, with an accompanying ejection of a staple from the magazine by the driver element and a clinching of the thus ejected staple against the clinching element.

31 Claims, 9 Drawing Sheets

STAPLING PLIER

BACKGROUND OF THE INVENTION

1. Field of the Invention

This invention relates generally to fastener applying implements, and is concerned in particular with an improved stapling plier.

2. Description of the Prior Art

A well known and widely employed type of stapling plier is disclosed in U.S. Pat. Nos. 2,461,165 and 2,354,760 (Lindstrom). A primary objective of the present invention is to improve upon this known design by providing a smoother transmission of the leveraged forces produced as a result of squeezing the operating lever while driving and clinching a staple, thereby reducing the required operator effort involved.

Another objective of the present invention is to simplify and facilitate assembly of the plier components, thereby making it possible to realize important savings in manufacturing costs.

A further objective of the present invention is to provide improved guidance and support for the staples as they are being driven through various work elements.

A companion objective of the present invention is to facilitate the task of clearing jammed staples from the exit throat of the magazine.

SUMMARY OF THE INVENTION

In a preferred embodiment of the invention to be hereinafter described in greater detail, these and other objectives and advantages are achieved by providing a stapling plier having a magazine adapted to contain an inverted channel-shaped assembly (commonly referred to as a "stick") of U-shaped detachably interconnected staples, each staple having the conventional pair of legs joined by an integral crown. A driver arm and a clincher arm are arranged to respectively overlie and underlie the magazine. The rearward ends of the driver arm and the clincher arm are connected to the rearward end of the magazine, the latter having an exit throat at its forward end through which staples are driven into a work element gripped between the underside of the magazine and the clincher arm. Staples are driven out of the magazine through the exit throat by a driver carried on the driver arm. A clincher formed as part of the forward end of the clincher arm clinches the staples as they are driven out of the magazine and through the work element. The clincher arm and driver arm are biased into open positions by coacting internal springs, and an operating lever pivotally connected to the clincher arm provides the necessary leveraged force required to overcome the biasing action of the springs and to pivotally urge the driver arm and clincher arm into their respective closed positions during a stapling operation. Bearings are rotatably carried on the driver arm. The bearings and the operating lever have complimentary arcuate surfaces which coact in continuous contact to smoothly adjust to changes in mechanical advantage that occur during the stroke of the operating lever, the net result being a smooth transmission of leveraged forces to the pivotally coacting components of the plier.

Preferably, the bearings comprise injection molded plastic components which are snap-fitted into aligned apertures in the side walls of the driver arm, with the magazine being located between and slidably guided by inner portions of the bearings during each stapling operation.

The magazine is preferably provided with a floating core having a forward end configured to provide cam surfaces leading to forwardly protruding nose segments. The floating core is biased forwardly, thereby urging the nose segments against the front of the magazine at positions extending across the exit throat. During a stapling operation, the nose segments coact with the side walls of the magazine to laterally support and thus prevent buckling of the staple legs as the staples are ejected from the magazine and forcibly driven through the work elements. During the final stage of a stapling operation, the staple crown coacts with the cam surfaces to clear the forwardly protruding nose segments of the core from the throat.

DETAILED DESCRIPTION OF PREFERRED EMBODIMENT

Figure 1:
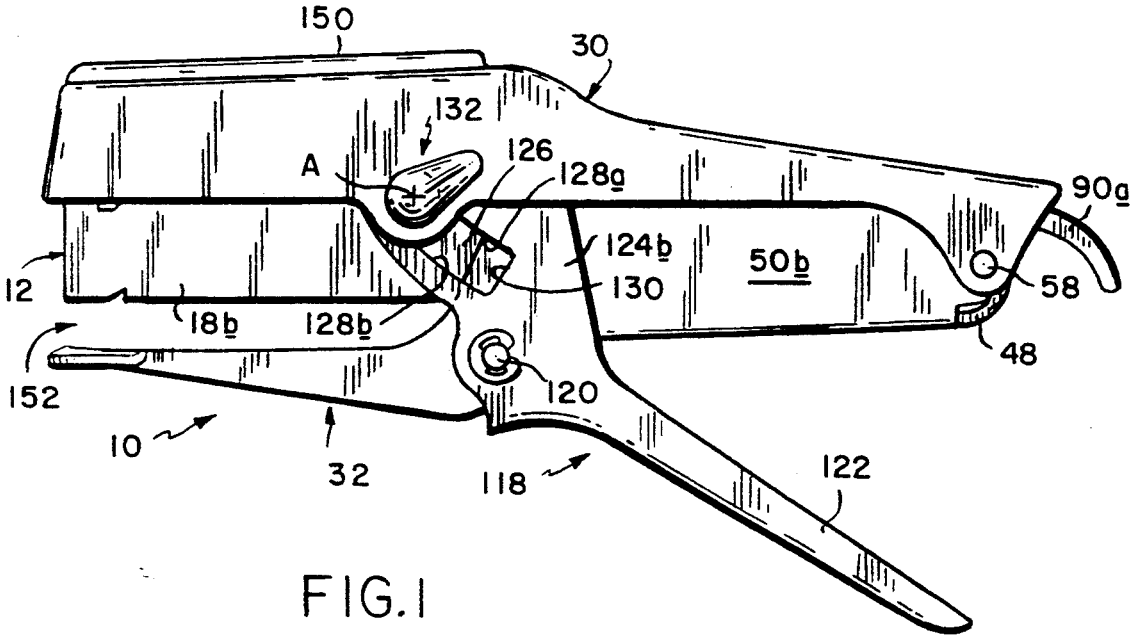
FIG. 1 is a view in side elevation of a stapling plier according to the present invention.
Figure 2:
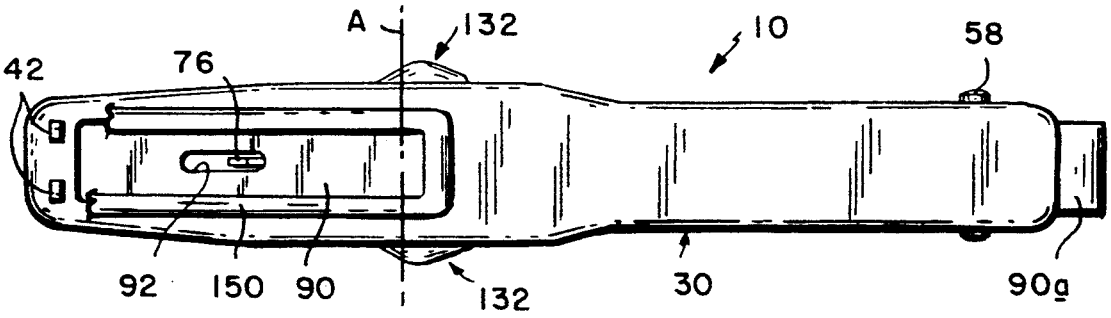
FIG. 2 is a top plan view of the stapling plier.
Figure 3:
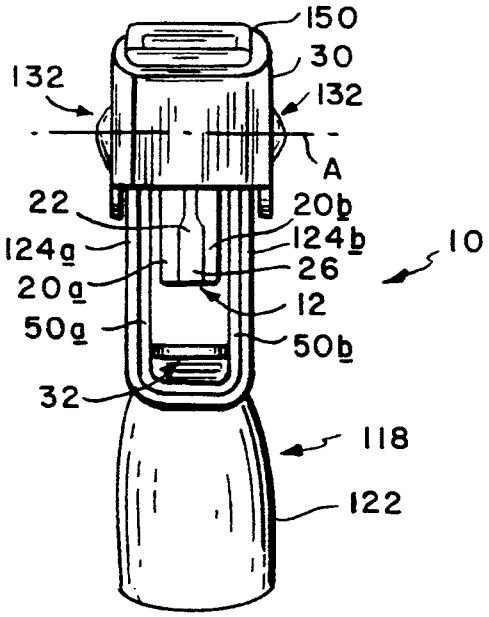
FIG. 3 is a front view of the stapling plier.

Referring initially to FIGS. 1–4, 19 and 20, a stapling plier according to the present invention is shown at 10. The plier includes a magazine 12 adapted to contain a stick 14 of U-shaped staples. The staples are conventional in design, and as can best be seen in FIGS. 10–14, each includes a pair of legs 14*a* joined by an integral crown 14*b*.

The magazine 12 is generally channel-shaped, with a bottom wall 16, parallel outer side walls 18*a*, 18*b* extending upwardly from the bottom wall to an elongate top opening, and turned in front wall segments 20*a*, 20*b* defining a space 22 therebetween, one of the front wall segments 20*a* having a rearwardly extending stop 24. At the forward end of the magazine, the bottom wall is turned back to provide a rearwardly facing lip 26. The lip 26, and the adjacent surfaces of the side walls 18*a*, 18*b* and the front wall segments 20*a*, 20*b* coact in providing an exit throat "T". At the rear end of the magazine, flanges 28 extend inwardly from the top edges of the side walls 18*a*, 18*b*.

A driver arm 30 overlies the magazine, and a clincher arm 32 underlies the magazine. The driver arm has a contoured top wall 34, a front wall 36, and parallel side walls 38*a*, 38*b*. The top wall includes a rectangular loading port 40 and two smaller mutually spaced apertures 42 at its forward end in a frontal rim bordering the loading port.

The clincher arm 32 has a bottom wall 44 defining a clincher cavity 46 at its forward end and having an upturned flange 48 at its rearward end. Side walls 50*a*, 50*b* extend upwardly from the bottom wall 44. As can be best seen in FIG. 19, the frontal edges of the side walls 50*a*, 50*b* are each configured to define inclined contact surfaces 52, with side wall 50*a* having a forwardly projecting ear 54, and with side wall 50*b* having a rearwardly projecting ear 56.

Figure 4:
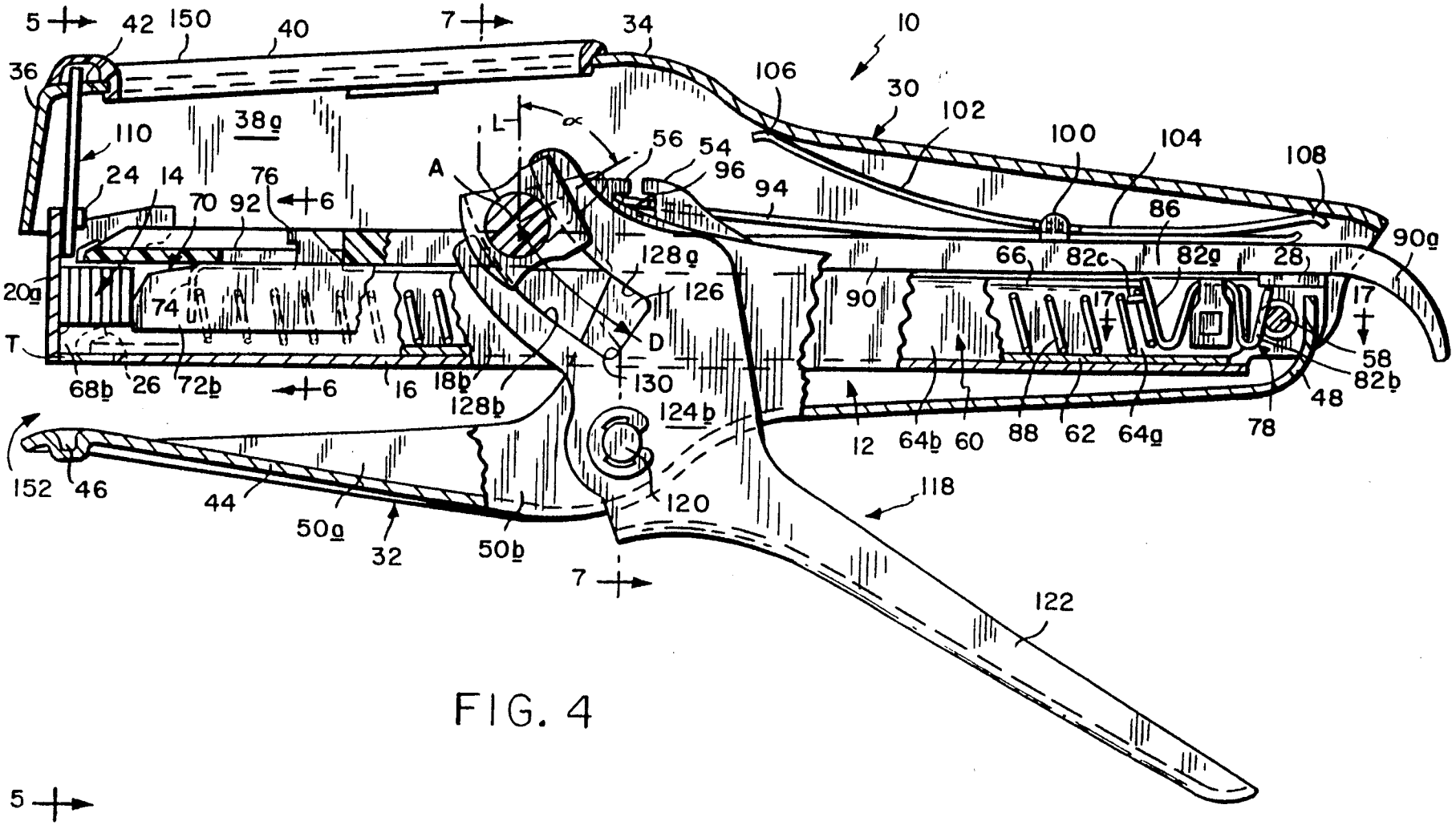
FIG. 4 is an enlarged side view of the stapling plier in the open position with portions broken away in order to better illustrate internal components.
Figure 7:
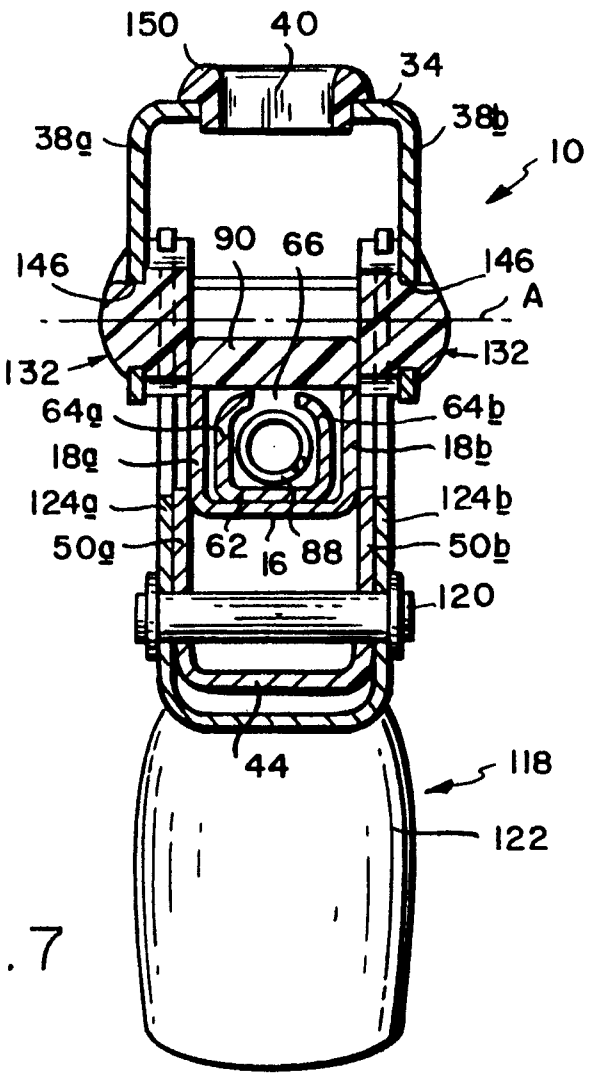
FIGS. 5, 6 and 7 are sectional views taken respectively along lines 5—5, 6—6 and 7—7 of FIG. 4.
Figure 6:
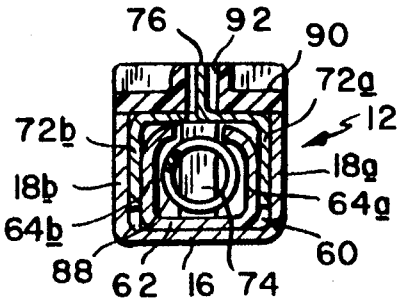

A pin 58 extends laterally through aligned apertures at the rearward ends of the magazine 12, the driver arm 30 and the clincher arm 32 to provide a pivotal connection therebetween, with the forward ends of the driver arm and clincher arm being pivotally movable in relation to the magazine between open and closed positions, the open positions being best illustrated in FIGS. 1 and 4.

The magazine contains a longitudinally extending core member 60 having a bottom wall 62 and upstanding interior side walls 64*a*, 64*b*, the upper edges of which are turned in to define a top slot 66. The core member is free to move longitudinally and laterally within the magazine and is adapted to slidably support a stick 14 of staples received in the magazine via the loading port 40. The legs 14*a*, 14*b* of the staples are laterally confined between the outer side walls 18*a*, 18*b* of the magazine 12 and the interior side walls 64*a*, 64*b* of the core member 60. The interior side walls of the core member have front edges configured to provide vertical segments 68*a* joined to forwardly protruding nose segments 68*b* by intermediate curved cam segments 68*c*.

A pusher element 70 is carried on and movable longitudinally along the core member 60. The pusher element has an inverted generally channel-shaped configuration, with side walls 72*a*, 72*b* located between the outer side walls 18*a*, 18*b* of the magazine 12 and the interior side walls 64*a*, 64*b* of the core member. The pusher 70 has a depending front lip 74 located within the core member 60, and a nose 76 protruding upwardly through the slot 66.

A retainer spring 78 is located at the rear of the core. As can be best seen in FIGS. 17 and 18, the retainer spring has an inverted generally channel-shaped configuration, with side walls 80*a*, 80*b* protruding downwardly from a top wall 82. The side walls have protrusions received in a snap engagement fit in rectangular openings 84 in the core side walls 64*a*, 64*b*.

Figure 17:
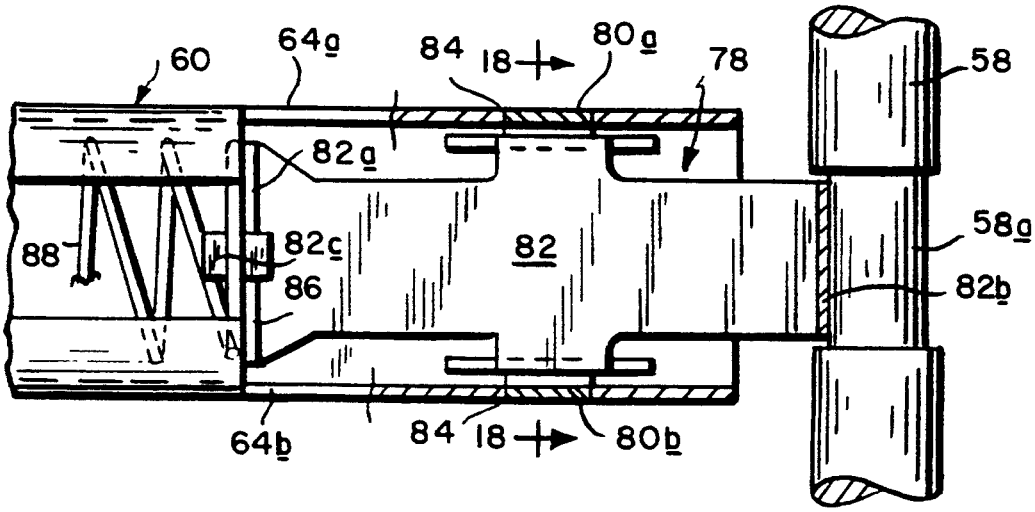
FIG. 17 is an enlarged sectional view taken along line 17—17 of FIG. 4.
Figure 18:
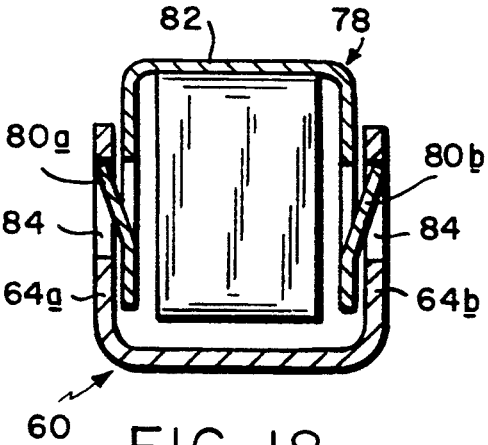
FIG. 18 is a sectional view taken along lines 18—18 of FIG. 17.
Figure 19:
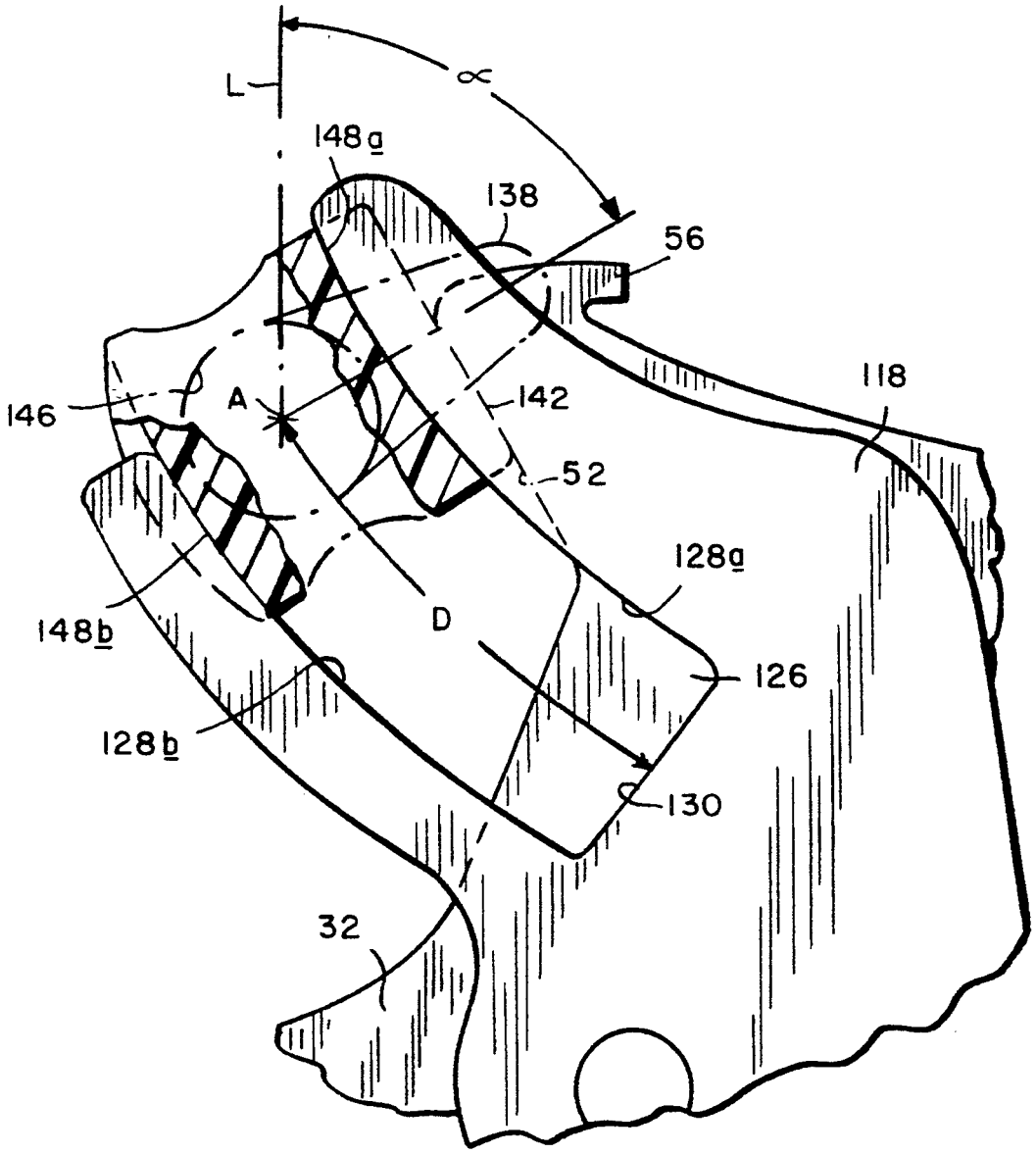
FIG. 19 is an enlarged view of a drive bearing and its associated components.
Figure 20:
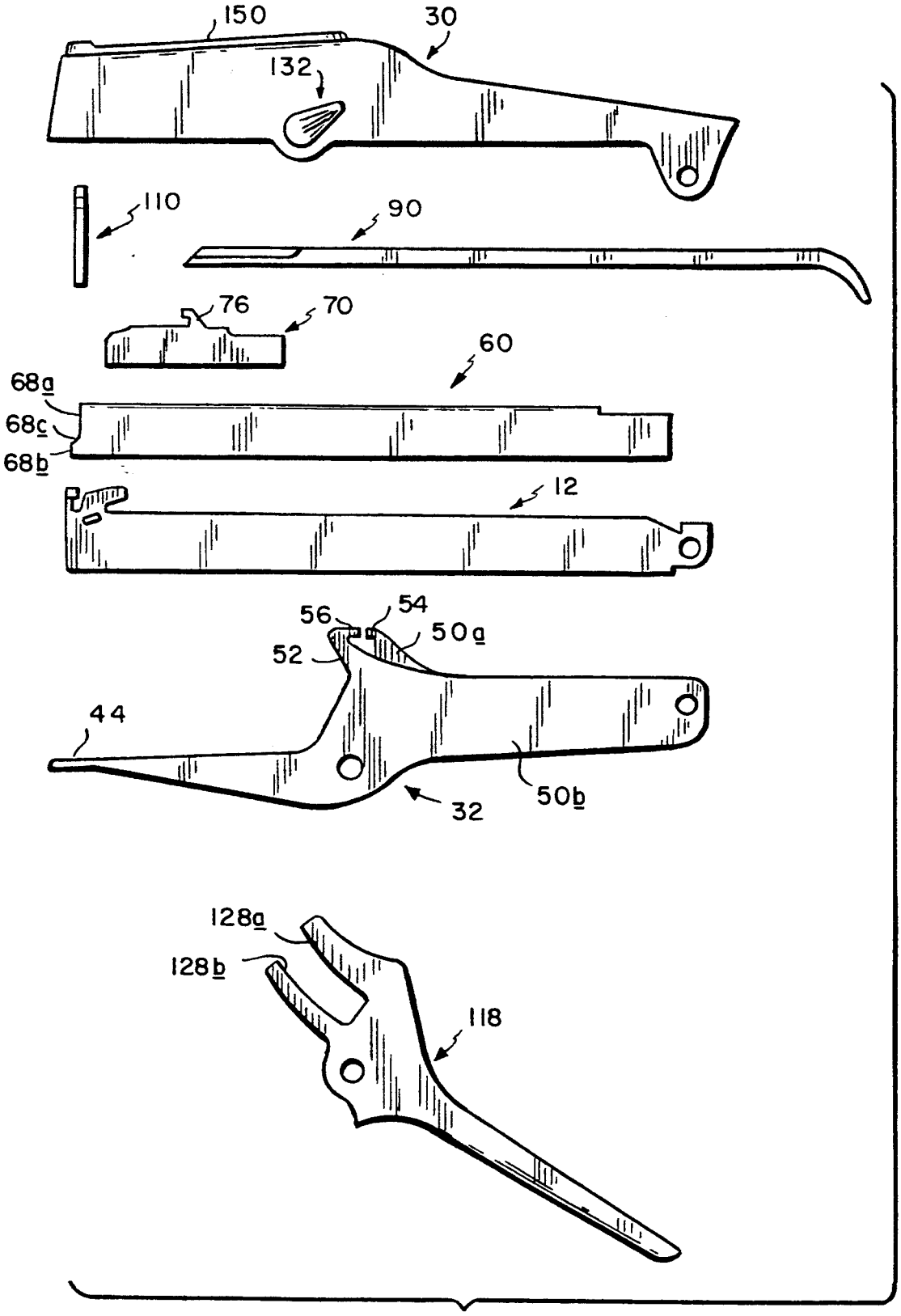
FIG. 20 is a disassembled view of some of the major components of the plier assembly.

As shown for example in FIGS. 4 and 17, the top wall 82 of the spring has a generally "W" shaped configuration, with a front leaf 82*a* bearing against the rear of the core member as at 86, and with a rear leaf 82*b* bearing against a reduced diameter portion 58*a* of the pivot pin 58. A coiled spring 88 is confined axially between the front leaf 82*a* of the retainer spring and the depending front lip 74 of the pusher 70. Lanced tab 82*c* of retainer front leaf 82*a* resides inside coiled spring 88, to prevent unwanted upward movement of retainer front leaf 82*a* as it bears against the rear of core member 60 at 86. The spring 88 urges the pusher forwardly, thereby locating the end-most front staple of the stick 14 against the front wall segments 20*a*, 20*b* of the magazine 12. The resilient engagement of the rear leaf 82*b* of the retainer spring 78 within the reduced diameter portion 58*a* of the pivot pin serves to prevent accidental axial dislodgement of the pivot pin. The retainer spring is resiliently confined between the core member 60 and the pivot pin 58, thereby resiliently urging the core forwardly to urge the forwardly protruding core nose segments 68*b* against the front wall segments 20*a*, 20*b* of the magazine.

A magazine cover 90 overlies the magazine and is provided with a downturned curved handle portion 90*a* protruding exteriorly from the rear end of the driver arm 30. The magazine cover is preferably molded of a non-metallic plastic material, and has a top slot 92 receiving the upwardly protruding nose 76 of the pusher 70.

When loading staples into the plier, the magazine cover is first pulled rearwardly (to the right as viewed in FIG. 4). When this is done, the forward edge of the slot 92 engages the nose 76 of the pusher, thereby pulling the pusher rearwardly against the biasing force of the spring 88. This clears both the magazine cover and the pusher from beneath the loading port 40, thus enabling a stick of staples to be inserted through the loading port onto the core. The magazine cover is then returned to the position shown in FIG. 4. The staples are thus vertically confined between the core and the underside of the magazine cover, and are urged forwardly by the pusher.

A clincher arm spring 94 has laterally protruding front tabs 96 located between the clincher arm ears 54, 56. A rearward portion of spring 94 bears against the magazine cover 90 as at 98. The clincher arm spring has intermediate vertically protruding ears 100 between which is located a driver arm spring 102, which is suitably notched on each side to receive ears 100, thus fixing the working position of spring 102. The driver arm spring bears against the clincher arm spring as at 104, and its ends bear against the underside of the driver arm top wall 34 as at 106 and 108. The clincher arm spring 94 and the drive arm spring 102 serve respectively to resiliently bias the clincher arm and the driver arm into the open positions shown in FIG. 4.

A driver 110 is carried on the driver arm 30 at the forward end thereof. The driver has a blade portion 112 with vertically protruding resilient legs 114 snap-fitted into the spaced apertures 42 in the frontal rim of the driver arm. An upper edge 116 of the blade portion 112 engages the stop 24 on one of the front wall segments 20*a* of the magazine to thereby limit the extent to which the driver arm can be biased vertically in relation to the magazine by the driver arm spring 102. The driver 110 is suspended from the frontal rim of the driver arm and thus is free to pivot about an axis parallel to the axis of pivot pin 58. The driver is also free to float front-to-rear, thus avoiding any tendency to bind in the magazine 12.

An operating lever 118 is pivotally connected to the clincher arm 32 by a second pivot pin 120. The operating lever has a handle portion 122 diverging angularly from the underside of the clincher arm 32, and a head portion having mutually spaced side walls 124*a*, 124*b*. Arcuate slots 126 extend into the side walls 124*a*, 124*b*. Each slot 126 has parallel arcuate edges 128*a*, 128*b* leading to a base 130.

Figure 15:
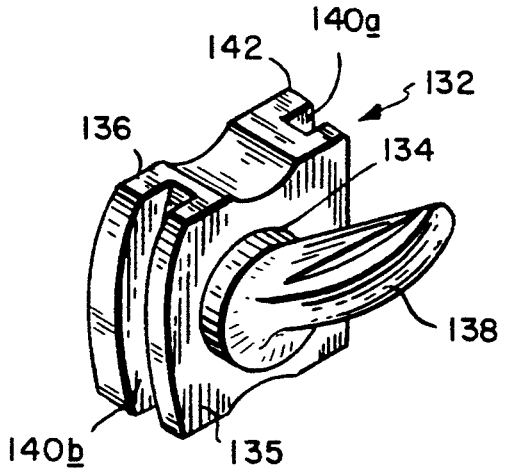
FIG. 15 is an enlarged perspective view of one of the driver arm bearings.
Figure 16:
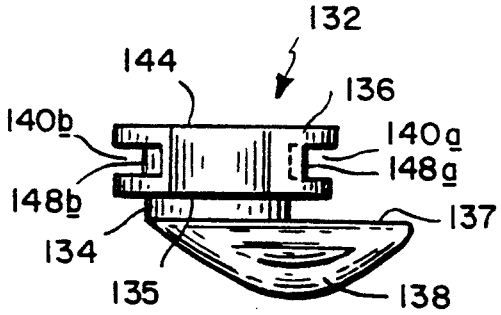
FIG. 16 is a top plan view of the driver arm bearing shown in FIG. 15.

Drive bearings 132 are interposed between the head portion of the operating lever 118 and the driver arm 30. The drive bearings preferably comprise injection molded plastic components. As can best be seen by additional reference to FIGS. 15 and 16, the drive bearings have cylindrical intermediate sections 134 extending between inner portions 136 and external ears 138. The inner portions 136 are each configured to define oppositely facing arcuate grooves 140*a*, 140*b*, a flat stop shoulder 142, and a flat interior guide surface 144.

The planar side walls of the driver arm have aligned openings 146 in which the cylindrical intermediate sections 134 of the drive bearings 132 are journalled for rotation about an axis "A" parallel to the axes of pivot pins 58 and 120. When driving staples, the drive arm side walls 38*a*, 38*b* are tightly gripped by the drive bearings 132 between the flat surfaces 135 of inner portions 136 and the confronting flat surfaces 137 of external ears 138 to insure perpendicularity of the drive bearings while under load. As can best be seen by additional reference to FIG. 19, the grooves 140*a*, 140*b* have arcuate base surfaces 148*a*, 148*b* in continuous contact respectively with the arcuate edges 128*a*, 128*b* of grooves 126 in the head portion of the operating lever 118. The flat contact surfaces 52 of the clincher arm bear against the stop shoulders 142 of the drive bearings, and the side walls 18*a*, 18*b* of the magazine 12 are slidably confined between the opposed guide surfaces 144.

Figure 5:
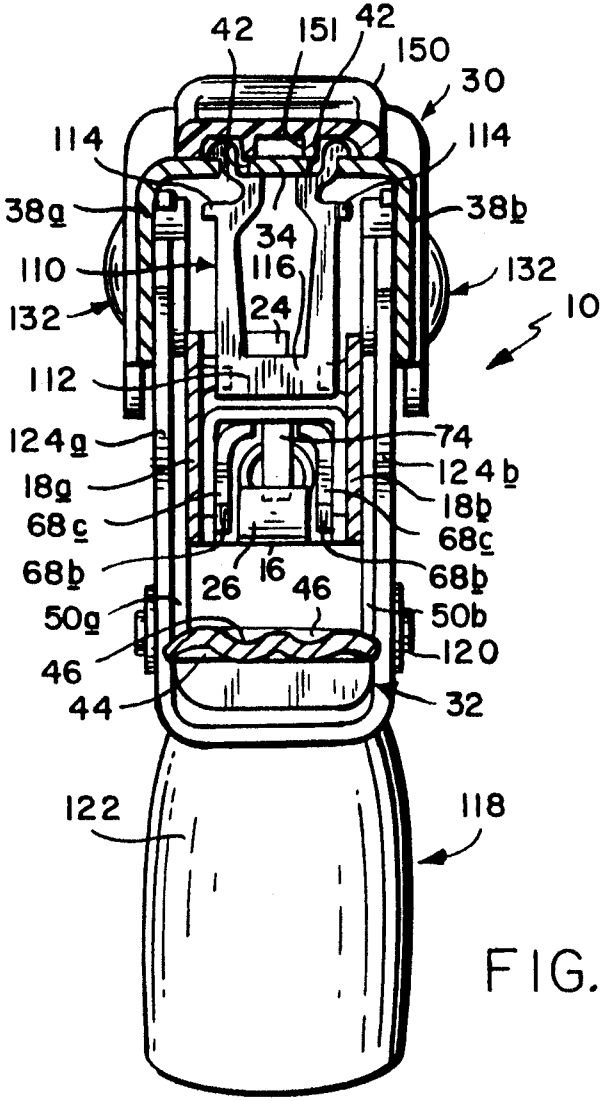

The loading port 40 is preferably bordered by a rectangular plastic liner 150 which is snap-fitted into place, and which has a forward edge overlying and enclosing the points of connection of the driver 110 to the forward rim of the driver arm 30. As can best be seen in FIG. 5, rib portions 151 of plastic liner 150 reside between the enclosed points of driver legs 114, to prevent unwanted flexure and possible disengagement should the stapler be severely jarred, as for example as a result of being dropped.

The stapling plier of the present invention operates as follows: in the open position as illustrated typically in FIG. 4, the biasing action of the driver arm spring 102 is limited by the interengagement of the driver 110 with the driver arm stop 24. Likewise, the biasing action of the clincher arm spring 94 is limited by contact between the contact surfaces 52 on the clincher arm and the stop surfaces 142 on the drive bearings 132. The forward end of the clincher arm is spaced beneath the underside of the magazine to define a work element receiving gap 152 therebetween. The ears 138 on the drive bearings 132 are disposed at an angle $\alpha$ with respect to a vertical reference line "L" passing through the axis A, and the axis A is spaced from the base 130 of arcuate notch 126 by a distance "D".

Figure 8:
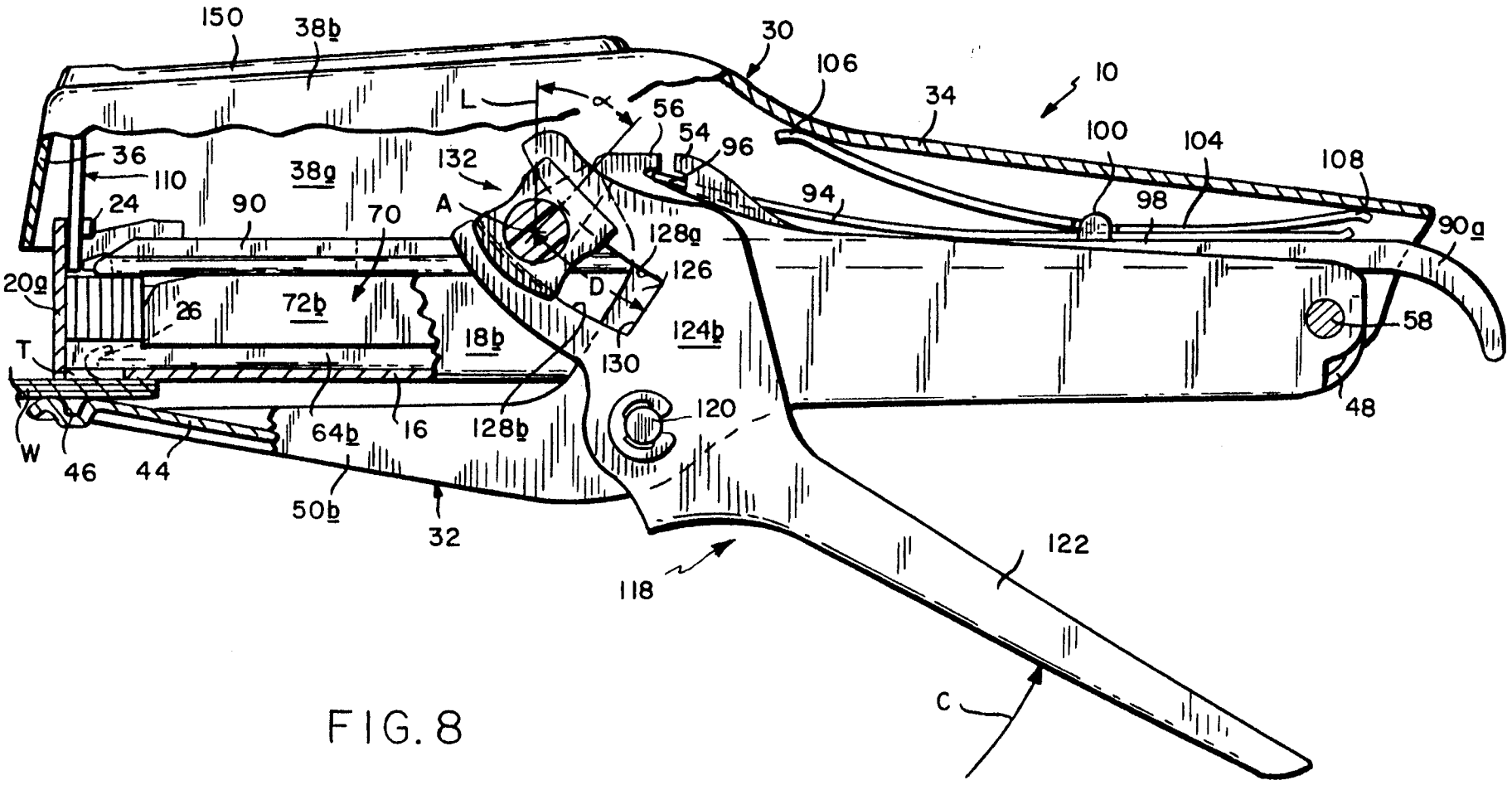
FIG. 8 is a view similar to FIG. 4 showing the stapler partially closed to grip a work element between the underside of the magazine and the forward end of the clincher arm prior to commencement of the staple driving sequence.

With reference to FIG. 8, pivotal closure of the handle 122 in the direction indicated by arrow "C" will cause the clincher arm 32 and magazine 12 to close on a work element "W" inserted therebetween. The angle $\alpha$ will have been diminished as the drive bearings 132 rotate about axis A in order to maintain a continuous contact between the arcuate edges 128*a* of slots 126 and the arcuate contact surfaces 148*a* of the drive bearings 132. The distance D will also have been diminished as the axis A progresses into the slots 126.

Figure 9:
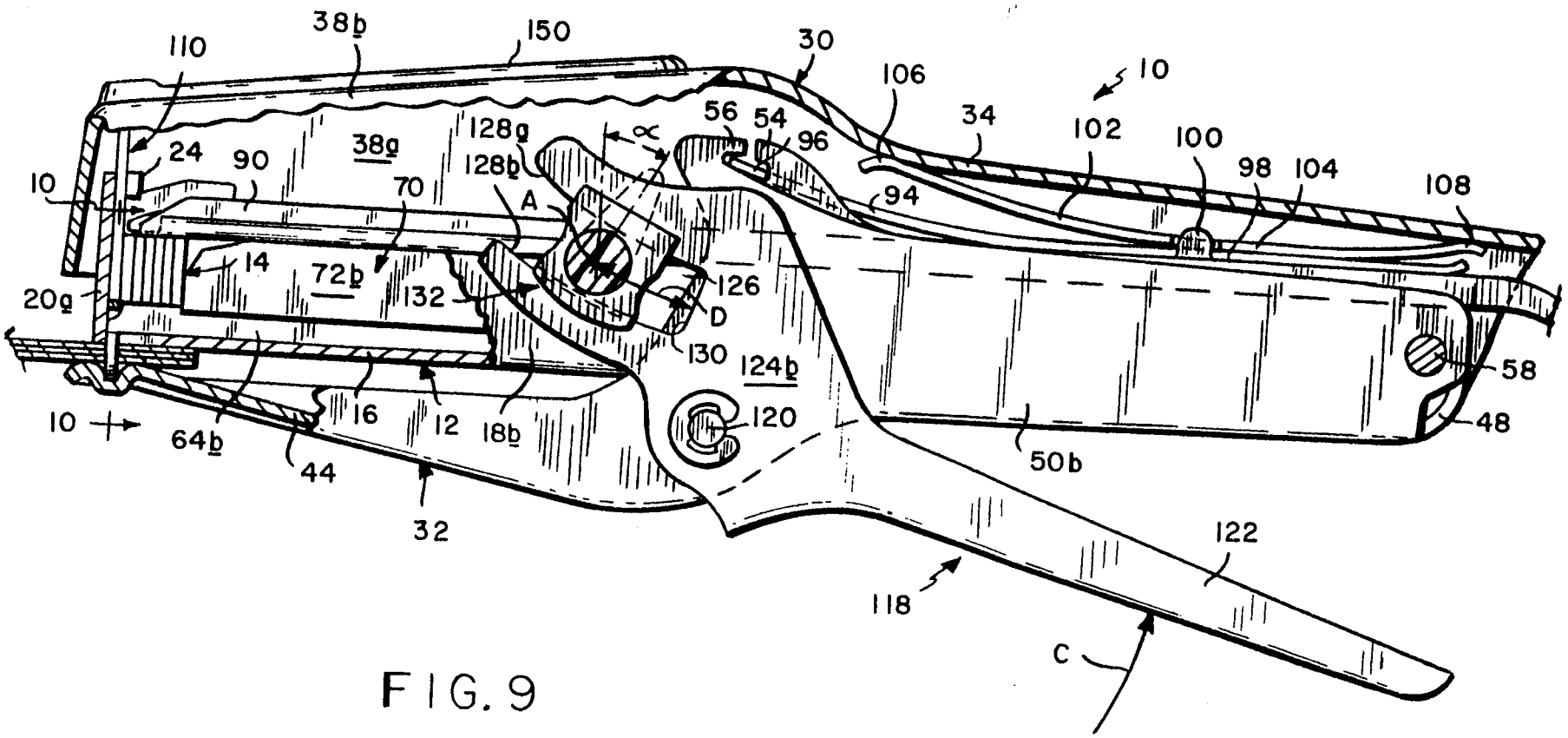
FIG. 9 is a view similar to FIG. 8 showing a subsequent stage in the stapling sequence.

As depicted in FIG. 9, further pivotal closure of the handle 122 in the direction C will overcome the biasing action of spring 102, thereby producing movement of the driver arm 30 relative to the magazine 12. This relative movement will force the driver 110 into the magazine throat T, thereby displacing the end most staple of the stick 14 downwardly through the work element W. Relative movement between the driver arm and the magazine will continue to be accompanied by a reduction in angle $\alpha$ and distance D as the drive bearings rotate about axis A and enter deeper into the arcuate slots 126. As distance D diminishes, the operating lever 118 mechanical advantage increases, and as angle $\alpha$ decreases, the component force acting vertically through the drive bearings 132 increases, as it is a function of cosine $\alpha$.

Figure 10:
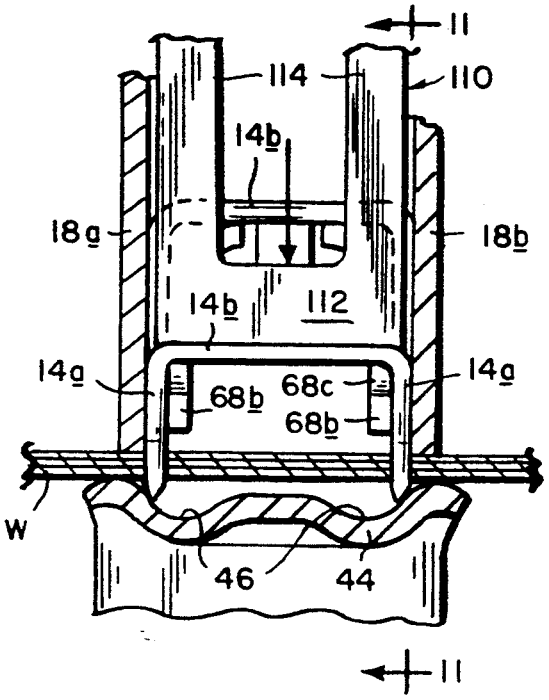
FIG. 10 is an enlarged cross sectional view through the magazine and clincher arm showing a staple driven through a work element by the driver.
Figure 11:
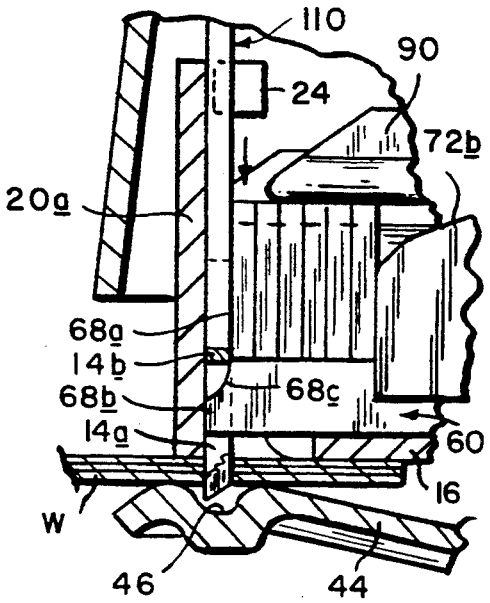
FIG. 11 is a sectional view taken along line 11—11 of FIG. 10.
Figure 12:
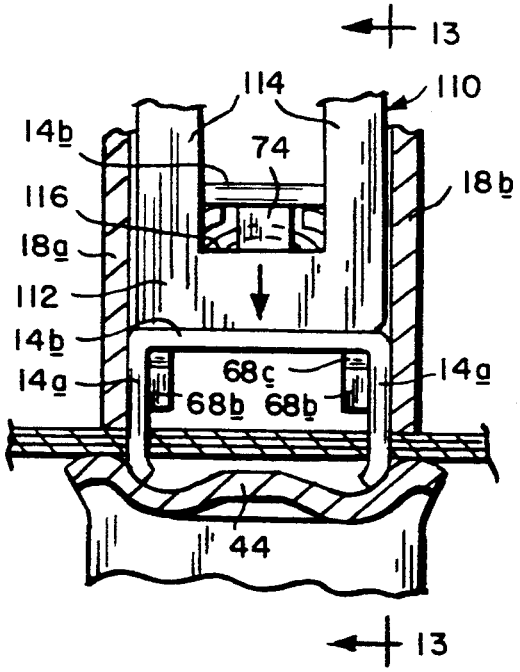
FIG. 12 is a view similar to FIG. 10 showing a further stage in the stapling operation.
Figure 13:
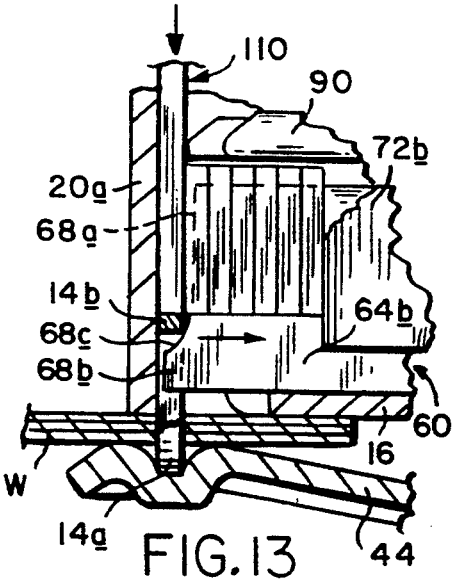
FIG. 13 is a sectional view along line 13—13 of FIG. 12 and showing the floating core being cammed rearwardly by the crown of the staple as the driver continues its downward stroke.
Figure 14:
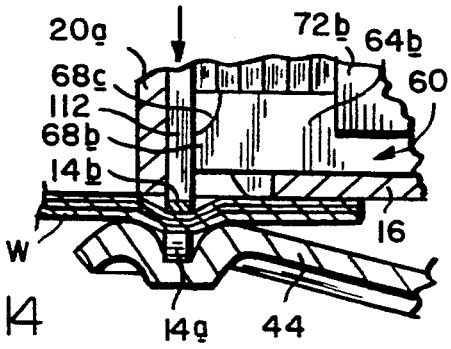
FIG. 14 is a view similar to FIG. 13 showing the driver at the lower most end of its stroke.

As shown in FIGS. 10 and 11, as the end most staple is driven from the magazine 12 through the work element W, the staple legs 14*a* are supported laterally from left to right between the inner surfaces of the magazine side walls 18*a*, 18*b* and the outer surfaces of the nose segments 68*b* of the core 60, the latter being biased against the front wall segments 20*a*, 20*b* of the magazine by the retainer spring 78. As shown in FIGS. 12 and 13, as the driver 110 continues its downward movement, the crown 14*b* of the staple slides over the core cam segments 68*c* and in so doing, urges the core rearwardly against the biasing action of the retainer spring, thereby clearing the nose segments 68*b* from the magazine throat T to allow continued downward passage of the staple crown. As shown in FIG. 14, at the final stage in the clinching operation, the core is held rearwardly by the blade portion 112 of the driver.

In light of the foregoing, it will now be apparent to those skilled in the art that the present invention offers a number of advantages over known stapling pliers. Of particular importance is the use of the rotatable drive bearings 132 with arcuate grooves 140*a*, 140*b* having arcuate base surfaces 148*a*, 148*b* arranged to coact in continuous slidable engagement with the arcuate edges 128*a*, 128*b* of the arcuate slots 126 in the operating lever 118. These continuous arcuate lines of contact, which are maintained throughout each stapling cycle as a result of relative rotation between the drive bearings and the driver arm 30 about axis A, produce a smooth closure and crimping action.

The drive bearings 132 and the driver 110 are snap fitted into place, thereby avoiding the necessity to resort to riveting and thus simplifying assembly. Because the drive bearings are molded of a plastic rather than being fabricated metallic components, they provide a self lubricating feature which further enhances smooth motion of the components with which they coact. This is particularly beneficial with regard to guiding the pivotal motion of the magazine between the confronting inner bearing surfaces 144.

The core member 60 is a "floating element", i.e., it is free to move both laterally and axially within the magazine 12. Lateral movement allows the core to self adjust to dimensional variations encountered in the staple sticks 14. The forward biasing of the core by the retainer spring 78 allows the forward core nose segments **68*b*** to coact with the magazine walls in laterally supporting the staple legs during penetration into a work element, yet allows the nose segments to be biased rearwardly by the staple crown as the staple in crimped and ejected from the magazine. The floating action of the core also facilitates the task of clearing jammed staples from the magazine throat T. Plier assembly is further simplified by avoiding the common practice of permanently fastening the core to the magazine, as by welding or the like.

The retainer spring 78 is also snap fitted into place, and serves multiple functions, including confining the pusher 70 and coiled spring 88 within core 60, allowing snap assembly of the core and confined parts to the magazine 12, exerting a forward biasing action on the core member 60, and exerting a retaining action on the pivot pin 58.

The foregoing advantages combine to create a stapling plier that is extremely reliable, comfortable to operate, and convenient to assemble, thus benefiting the end user as well as the manufacturer.

I claim:

1. A stapling plier for stapling a work element, said plier comprising:

a magazine adapted to contain a supply of U-shaped staples detachably interconnected and arranged in an inverted channel-shaped assembly, each of said staples having a pair of legs joined by an integral crown;

a driver arm overlying said magazine;

a clincher arm underlying said magazine, each said magazine, driver arm and clincher arm having forward and rearward ends;

first pivot means for interconnecting the rearward ends of said driver arm and said clincher arm to the rearward end of said magazine, said first pivot means establishing a single axis about which the forward ends of both said driver arm and said clincher arm are pivotally movable between open and closed positions with respect to the forward end of said magazine;

means defining a throat at the forward end of said magazine;

pusher means associated with said magazine for urging an assembly of staples contained therein towards the forward end of said magazine to thereby position an end most staple of said assembly at said throat;

a driver carried by said driver arm at the forward end thereof at a position aligned with said throat, said driver being retracted from said throat when said driver arm is in said open position, and being movable into said throat in response to pivotal movement of said driver arm into said closed position to eject said end most staple from said magazine;

a clincher carried by said clincher arm at the forward end thereof, said clincher being spaced from said magazine to define a work element receiving gap when said clincher arm is in said open position, and being movable towards said magazine in response to pivotal movement of said clincher arm into said closed position to grip a work element received in said gap and to coact with said driver in clinching a staple being ejected from said magazine and driven through said work element by said driver;

first spring means for yieldably biasing said clincher arm into said open position;

second spring means for yieldably biasing said driver arm into said open position;

bearings carried on said driver arm for rotation about an axis fixed in relation to the single axis of said first pivot means;

an operating lever;

second pivot means for connecting said operating lever to said clincher arm for pivotal movement between first and second positions, said operating lever and said bearings having complimentary arcuate surfaces which coact in sliding engagement in response to pivotal movement of said operating lever from said first position to said second position to accommodate relative movement between said bearings and said second pivot means with an accompanying exertion of a closing force overcoming the biasing forces of said first and second spring means and causing said clincher arm and said driver arm to pivot sequentially relative to said magazine into their respective closed positions.

2. The stapling plier of claim 1 wherein said bearings comprise injection molded plastic components.

3. The stapling plier of claims 1 or 2 wherein said driver arm includes parallel planar side walls, and wherein said bearings are rotatably mounted in aligned apertures in said side walls.

4. The stapling plier of claim 3 wherein said bearings include inner and outer portions located respectively internally and externally of said driver arm and joined by intermediate portions extending through and rotatably journalled within said apertures, the side walls of said driver arm being gripped between said inner and outer portions when said bearings are under said closing force.

5. The stapling plier of claim 4 wherein said magazine is arranged between and slidably guided by the inner portions of said bearings.

6. The stapling plier of claim 4 wherein said inner portions define stop surfaces against which said clincher arm is biased by said first spring means.

7. The stapling device of claim 4 wherein said inner portions include parallel arcuate surfaces confined between parallel arcuate surfaces of arcuate slots in said operating lever.

8. The stapling plier of claim 3 wherein the arcuate surfaces of said bearings are located on said inner portions.

9. The stapling plier of claim 8 wherein said closing force produces moments urging said interior and exterior portions of said bearings against the respective side walls of said driver arm.

10. The stapling plier of claim 1 wherein said driver arm includes a rim overlying said throat, said driver depending from and being secured to said rim for pivotal movement about a reference axis parallel to the pivotal axes of said first and second pivot means.

11. The stapling plier of claim 10 wherein said rim includes at least two apertures spaced along said reference axis, and wherein said driver has resilient legs received in a snap engagement within said apertures.

12. The stapling plier of claim 10 wherein said magazine includes a stop surface, and wherein said driver is biased against said stop surface by said second spring means.

13. The stapling plier of claim 1 wherein said magazine has a bottom wall, parallel outer side walls extending upwardly from said bottom wall to a top opening, and front wall segments extending inwardly from said side walls, said bottom and side walls and said front wall segments coacting in spaced relationship to define said throat.

14. The stapling plier of claim 13 further comprising a core member extending longitudinally within said magazine, said core member being adapted to support a supply of staples received in said magazine via said top opening.

15. The stapling plier of claim 14 wherein said core member is movable longitudinally within said magazine, and third spring means for biasing a forward end of said core member against the front wall segments of said magazine.

16. The stapling plier of claim 15 wherein said core member includes inner side walls spaced inwardly from the outer side walls of said magazine, the legs of a supply of staples supported on said core member being confined between said inner and outer side walls.

17. The stapling plier of claim 16 wherein the inner side walls of said core member have front edges configured to provide vertical segments joined to forwardly protruding nose segments by curved cam segments, said nose segments extending across said throat and being biased by said third spring means into engagement with said front wall segments.

18. The stapling plier of claim 17 wherein said nose segments coact in spaced relationship with said outer side walls to laterally confine the legs of staples being ejected from said magazine via said throat, said curved cam segments being arranged to coact with the crowns of the thus ejected staples to urge said core rearwardly against the biasing action of said third spring means, thereby removing said nose segments from the path of the ejected staples.

19. The stapling plier as claimed in claim 15 wherein said pusher means comprises a pusher element carried on and movable longitudinally along said core member, and fourth spring means for biasing said pusher element forwardly.

20. The stapling plier of claim 19 wherein said third spring means comprises a leaf spring having first and second resilient leaf segments and resilient ear segments, said ear segments being engageable in a snap fit with openings in the side walls of said core to detachably secure said third spring means to said core, said fourth spring means comprising a coiled spring axially confined between said pusher element and the first leaf segment of said third spring means.

21. The stapling plier of claim 20 wherein said first pivot means comprises a pivot pin removably inserted through aligned openings in the rearward ends of said magazine, said driver arm and said clincher arm, said pivot pin being resiliently engaged and removably held in place by the second leaf segment of said third spring means.

22. The stapling plier of claim 1 wherein said magazine has a top opening, and a cover slidably associated with said magazine for movement between a retracted position allowing staples to be loaded into said magazine through said top opening, and an advanced position blocking said opening.

23. The stapling plier of claim 22 wherein said pusher means is retracted from said top opening by movement of said cover to said retracted position.

24. The stapling plier of claim 22 wherein said first spring means is resiliently confined between said cover and said clincher arm.

25. The stapling plier of claim 24 wherein said second spring means is resiliently confined between said first spring means and said driver arm.

26. A stapling plier for stapling a work element, said plier comprising:

a magazine adapted to contain a supply of U-shaped staples detachably interconnected and arranged in an inverted channel-shaped assembly, each of said staples having a pair of legs joined by an integral crown;

a driver arm overlying said magazine, said driver arm having parallel side walls with aligned apertures extending therethrough;

a clincher arm underlying said magazine, each said magazine, driver arm and clincher arm having forward and rearward ends;

first pivot means for pivotally connecting the rearward ends of said driver arm and said clincher arm to the rearward end of said magazine, said first pivot means establishing a single axis about which the forward ends of both said driver arm and said clincher arm are pivotally movable between open and closed positions with respect to the forward end of said magazine;

means defining a throat at the forward end of said magazine;

pusher means associated with said magazine for urging an assembly of staples contained therein towards the forward end of said magazine to thereby position an end most staple of said assembly at said throat;

a driver carried by said driver arm at the forward end thereof at a position aligned with said throat, said driver being retracted from said throat when said driver arm is in said open position, and being movable into said throat in response to pivotal movement of said driver arm into said closed position to eject said end most staple from said magazine;

a clincher carried by said clincher arm at the forward end thereof, said clincher being spaced from said magazine to define a work element receiving gap when said clincher arm is in said open position, and being movable towards said magazine in response to pivotal movement of said clincher arm into said closed position to grip a work element received in said gap and to coact with said driver in clinching a staple being ejected from said magazine and driven through said work element by said driver;

first spring means for yieldably biasing said clincher arm into said open position;

second spring means for yieldably biasing said driver arm into said open position;

bearings carried on said driver arm, said bearings having inner and outer portions located respectively internally and externally of said driver arm and joined by intermediate portions extending through and journalled within the aligned apertures in said driver arm for rotation about an axis fixed in relation to the single axis of said first pivot means;

an operating lever; and second pivot means for connecting said operating lever to said clincher arm for pivotal movement between first and second positions, said operating lever and said bearings having complimentary arcuate surfaces which coact in sliding engagement in response to movement of said operating lever from said first position to said second position to thereby generate a closing force overcoming the biasing forces of said first and second spring means and pivoting said clincher arm and said driver arm relative to said magazine into their respective closed positions.

27. A stapling plier for stapling a work element, said plier comprising:

a magazine adapted to contain a supply of U-shaped staples detachably interconnected and arranged in an inverted channel-shaped assembly, each of said staples having a pair of legs joined by an integral crown, said magazine having a bottom wall, parallel outer side walls extending upwardly from said bottom wall to a top opening, and front wall segments extending inwardly from said side walls, said bottom and side walls and said front wall segments coacting in spaced relationship to define a throat;

a core member movable longitudinally within said magazine, said core member being adapted to support said supply of staples received in said magazine via said top opening;

a driver arm overlying said magazine, said driver arm having parallel side walls with aligned apertures extending therethrough;

a clincher arm underlying said magazine, each said magazine, driver arm and clincher arms having forward and rearward ends;

first pivot means for pivotally connecting the rearward ends of said driver arm and said clincher arm to the rearward end of said magazine, the forward ends of said driver arm and clincher arm being pivotally movable between open and closed positions with respect to the forward end of said magazine;

means defining a throat at the forward end of said magazine;

pusher means associated with said magazine for urging an assembly of staples contained therein towards the forward end of said magazine to thereby position an endmost staple of said assembly at said throat;

a driver carried by said driver arm at the forward end thereof at a position aligned with said throat, said driver being retracted from said throat when said driver arm is in said open position, and being movable into said throat in response to pivotal movement of said driver arm into said closed position to eject said endmost staple from said magazine;

a clincher carried by said clincher arm at the forward end thereof, said clincher being spaced from said magazine to define a work element receiving gap when said clincher arm is in said open position, and being movable towards said magazine in response to pivotal movement of said clincher arm into said closed position to grip a work element received in said gap and to coact with said driver in clinching a staple being ejected from said magazine and driven through said work element by said driver;

first spring means for yieldably biasing said clincher arm into said open position;

second spring means for yieldably biasing said driver arm into said open position;

third spring means for biasing a forward end of said core member against the front wail segments of said magazine, said third spring means comprising a leaf spring having first and second resilient leaf segments and resilient ear segments, said ear segments being engageable in a snap fit with openings in the side walls of said core member to detachably secure said third spring means to said core member;

fourth spring means for biasing said pusher means forwardly, said fourth spring means comprising a coiled spring axially confined between said pusher means and the first leaf segment of said third spring means;

bearings carried on said driver arm;

an operating lever;

second pivot means for connecting said operating lever to said clincher arm for pivotal movement between first and second positions, said operating lever and said bearings having complimentary arcuate surfaces which coact in sliding engagement in response to movement of said operating lever from said first position to said second position to thereby generate a closing force overcoming the biasing forces of said first and second spring means and pivoting said clincher arm and said driver arm relative to said magazine into their respective closed positions.

28. A stapling plier for stapling a work element, said plier comprising:

a magazine adapted to contain a supply of U-shaped staples detachably interconnected and arranged in an inverted channel-shaped assembly, each of said staples having a pair of legs joined by an integral crown, said magazine having a top opening, and a cover slidably associated with said magazine for movement between a retracted position allowing staples to be loaded into said magazine through said top opening, and an advanced position blocking said opening;

a driver arm overlying said magazine, said driver arm having parallel side walls with aligned apertures extending therethrough;

a clincher arm underlying said magazine, each said magazine, driver arm and clincher arm having forward and rearward ends;

first pivot means for pivotally connecting the rearward ends of said driver arm and said clincher arm to the rearward end of said magazine, said first pivot means establishing a single axis about which the forward ends of both said driver arm and said clincher arm are pivotally movable between open and closed positions with respect to the forward end of said magazine;

means defining a throat at the forward end of said magazine;

pusher means associated with said magazine for urging an assembly of staples contained therein towards the forward end of said magazine to thereby position an end most staple of said assembly at said throat;

a driver carried by said driver arm at the forward end thereof at a position aligned with said throat, said driver being retracted from said throat when said driver arm is in said open position and being movable into said throat in response to pivotal movement or said driver arm into said closed position to eject said endmost staple from said magazine;

a clincher carried by said clincher arm at the forward end thereof, said clincher being spaced from said magazine to define a work element receiving gap when said clincher arm is in said open position, and being movable towards said magazine in response to pivotal movement of said clincher arm into said closed position to grip a work element received in said gap and to coact with said driver in clinching a staple being ejected from said magazine and driven through said work element by said driver;

first spring means for yieldably biasing said clincher arm into said open position;

second spring means for yieldably biasing said driver arm into said open position;

bearings carried on said driver arm for rotation about an axis fixed in relation to the single axis of said first pivot means;

an operating lever;

second pivot means for connecting said operating lever to said clincher arm for pivotal movement between first and second positions, said operating lever and said bearings having complimentary arcuate surfaces which coact in sliding engagement in response to movement of said operating lever from said first position to said second position to thereby generate a closing force overcoming the biasing forces of said first and second spring means and pivoting said clincher arm and said driver arm relative to said magazine into their respective closed positions.

29. The stapling plier of claim 28 wherein said pusher means is retracted from said top opening by movement of said cover to said retracted position.

30. The stapling plier of claim 28 wherein said first spring means is resiliently confined between said cover and said clincher arm.

31. The stapling plier of claim 30 wherein said second spring means is resiliently confined between said first spring means and said driver arm.

* * * * *